United States Patent [19]

Urban et al.

[11] 4,345,707

[45] Aug. 24, 1982

[54] METHOD OF AUTOMATICALLY FRAMING A REVERSAL FILM PROVIDED WITH EDGE NOTCHES

[75] Inventors: Otfried Urban; Peter Mundt, both of Garmisch-Partenkirchen, Fed. Rep. of Germany

[73] Assignee: Geimuplast Peter Mundt GmbH & Co., KG, Farchant, Fed. Rep. of Germany

[21] Appl. No.: 100,550

[22] Filed: Dec. 5, 1979

[30] Foreign Application Priority Data

Dec. 8, 1978 [DE] Fed. Rep. of Germany ..... 2853158

[51] Int. Cl.[3] ..... B65H 17/40

[52] U.S. Cl. ..... 226/68; 83/58; 83/278

[58] Field of Search ..... 226/68, 67, 62, 70, 226/71, 52, 72, 8, 24, 33, 34, 37, 158, 167; 83/58, 278, 277

[56] References Cited

U.S. PATENT DOCUMENTS

| | | | |
|---|---|---|---|
| Re. 26,283 | 10/1967 | Gerlach | 226/68 X |
| 929,161 | 7/1909 | Oehring | 226/68 |
| 2,168,043 | 8/1939 | O'Grady | 226/68 |
| 2,301,054 | 11/1942 | Laing | 226/62 |
| 2,325,335 | 7/1943 | Meyers | 226/68 X |
| 2,359,140 | 9/1944 | Meitner | 83/277 X |
| 2,425,994 | 8/1947 | Chilton | 83/277 X |
| 3,469,754 | 9/1969 | Parker | 226/68 |
| 3,765,583 | 10/1973 | Mathes | 226/67 X |
| 3,874,576 | 4/1975 | Vines | 226/67 X |

FOREIGN PATENT DOCUMENTS

| | | |
|---|---|---|
| 280394 | 11/1927 | United Kingdom . |
| 793967 | 4/1958 | United Kingdom . |
| 887769 | 1/1962 | United Kingdom . |
| 1114027 | 5/1968 | United Kingdom . |
| 1369332 | 10/1974 | United Kingdom . |

*Primary Examiner*—Stanley N. Gilreath
*Attorney, Agent, or Firm*—Fleit & Jacobson

[57] ABSTRACT

In a method and apparatus for automatically mounting reversal film in slide frames, the edge of the film being notched at predetermined intervals, the notches are utilized for feeding the film through the framing apparatus which comprises a pivoted notch-engaging pawl on a reciprocatable carriage and two electrically parallel switches acting independently on a clutch of driving means for the carriage. One of the switches is mounted on the carriage and is operable by the pawl and the other is operable by a rotary cam plate.

6 Claims, 8 Drawing Figures

METHOD OF AUTOMATICALLY FRAMING A REVERSAL FILM PROVIDED WITH EDGE NOTCHES

The invention relates to a method for automatically framing a reversal film provided with edge notches, and to an apparatus for performing this method.

In photographic film, particularly miniature film and Instamatic film, it is conventional to provide the edges with notches which serve as information carriers during the automated further processing of the film. Thus, colour negatives or black and white negative films of a miniature or pocket size are so provided with notches at an edge that one edge notch appears at a fixed position for each negative that is capable of being copied. Very much over-exposed or under-exposed or completely unexposed positions are provided with no notch. When running through the printers, the film is moved by a friction drive through the gate of the equipment and the edge of the film is thereby mechanically or optically scanned. In the presence of a notch, the drive is stopped. The negative associated with this notch will then be disposed at the correct position for preparing a copy. Since strongly over-exposed or under-exposed portions of the film are unnotched, the feed will in these cases automatically progress until a processible negative again reaches the gate of the printer.

This known manner of operation can be applied to the processing of reversal films. Automatic notching machines which scan the reversal film electro-optically and provide it with an edge notch in accordance with the density are already known. The notched reversal films are processed further either so that the film is cut into individual lengths of for example five exposures and return to the customer in this form or it is already automatically framed in slide frames by the processor so as to be ready for projection.

The invention is based on the problem of utilising the edge notching of the film for the automatic slide framing so that it is not necessary to observe variations in the spacing of the frames on the film during the slide framing process.

According to the invention, this problem is solved in a method of the aforementioned kind in that the reversal film is fed by means of the edge notches. An advantageous embodiment of this method resides in that the reversal film is fed only when the edge notches are within a predetermined range of spacings.

The advantages achievable by the invention are that compensation of the frame bar spacings for the feeding step of the framing machine is effected automatically by scanning the notches so that the speed of the framing process and its reliability can be increased.

To carry out this method, an apparatus is provided that will be described in more detail hereinafter.

The invention will now be described in more detail with reference to the example of the drawing, wherein:

FIG. 1*a* is a diagrammatic representation of a film feeding mechanism;

FIG. 1*b* shows a circuit diagram of the film feeding mechanism illustrated in FIG. 1*a;*

Figure 1A:
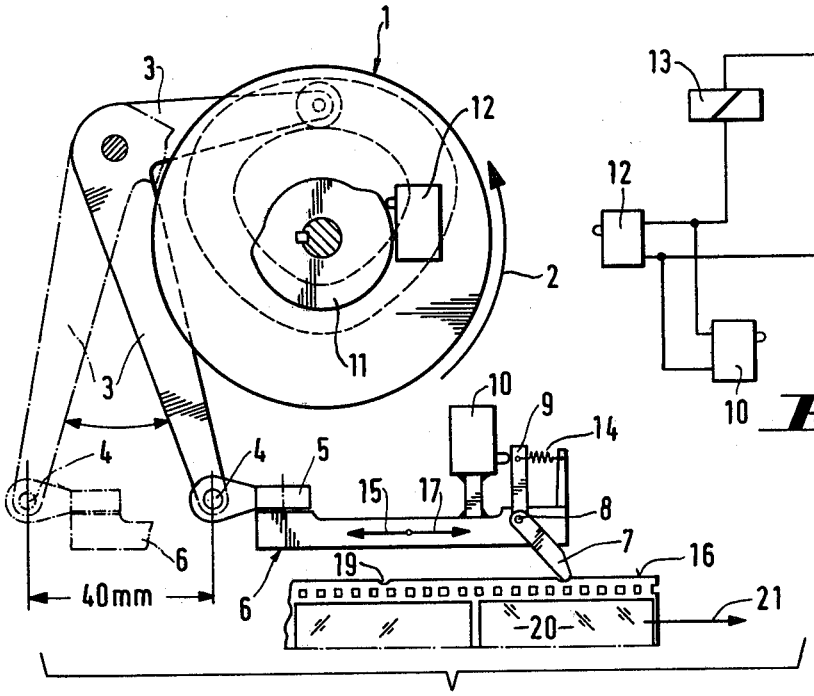
Figure 1B:
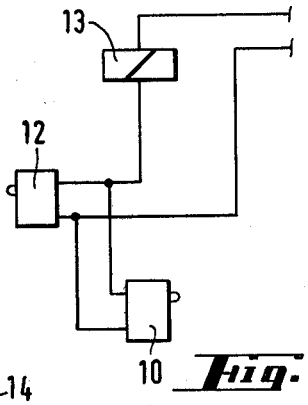

To drive the film, the cam plate 1, as illustrated in FIG. 1*a*, turns in the direction of the arrow 2 and thereby reciprocates the bell crank lever 3. The form of the cam is selected so that the point 4 of the bell crank lever 3 executes a displacement of 40 mm when framing a miniature film. The motion of the point 4 is transmitted to the film feed carriage 6 by way of a movable connecting element 5, the carriage being reciprocated along a slideway (not shown) and thereby likewise executing a stroke of 40 mm. The feed gripper 7 is seated on the film feed carriage 6. It is pivotable about the pivot 8. Rigidly connected to this pivot there is a lever arm 9 which moves together with the feed gripper 7 and thereby actuates the switch 10 which is rigidly connected to the carriage. On the same shaft as the cam plate 1 there is a cam plate 11 which actuates the switch 12. The switches 10 and 12 as illustrated in FIG. 1*b*, are connected in parallel and actuate an electromagnetic clutch 13.

Figure 2:
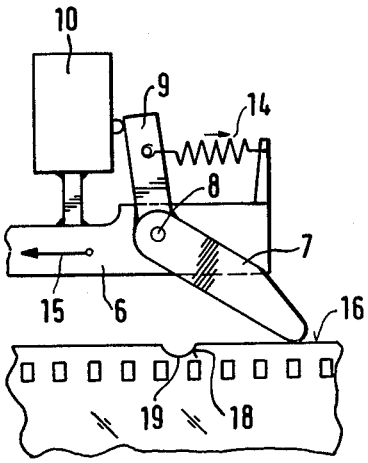
FIG. 2 shows the feed gripper out of engagement.
Figure 3:
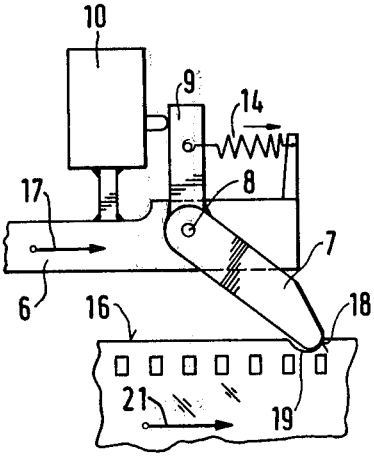
FIG. 3 shows the feed gripper in engagement with an edge notch.

Referring again to FIG. 1*a*, the tension spring 14 pulls the feed gripper 7 into the edge notch 19 of the film but has a force such that, on return movement of the film feed carriage 6 in the direction of the arrow 15, the gripper 7 slides out of the notch 19 and, as is shown in FIG. 2, slides over the unnotched edge 16 of the film until, at the end of the return stroke, the spring force makes it drop into the next edge notch 19 (see FIG. 3). On commencement of a new feed stroke in the direction of the arrow 17, the leading edge of the feed gripper 7 abuts the side 18 of the notch 19 and thereby pushes the film 20 in the direction of the arrow 21. The pivot point 8 of the feed gripper 7 is selected so that the feeding force produces a spring force component which is directed inwardly into the notch 19 and which is just large enough to hold the gripper 7 in the notch when the resistance to feeding is normal. At any larger resistance to feeding, however, the leading edge of the gripper 7 can slide off the side 18 of the notch 19 and then execute the remainder of the feeding stroke of the feed carriage 6 without further feeding of the film.

The cam plate 11 is set so that it closes the switch 12 during the entire return stroke (direction 15 of the bell crank lever 3) so that the magnetic clutch 13 remains activated. This clutch produces the connection between a drive motor (not shown) and the cam plate 1. The cam plate 11 is also constructed so that it keeps the switch 12 closed even when the direction of rotation of the film feed carriage 6 has already been reversed (transition from the direction 15 to direction 17) and the carriage 6 has moved through 4 mm in the feeding direction 17. Upon further motion in this direction, the cam plate 11 now allows the switch 12 to open. Whether or not the magnetic clutch 13 interrupts the drive and thus the connection between the motor and the cam plate 1 depends on whether the feed gripper 7 is disposed in an edge notch whereby the switch 10 acting as an opening member remains unactuated, i.e. closed. Only then will the magnetic clutch 13 remain activated and the normal feeding stroke for the film 20 is executed. However, if the gripper 7 is in a position as shown in FIG. 2, the switch 10 has been opened by the lever arm 9 and feeding is interrupted.

Figure 4:
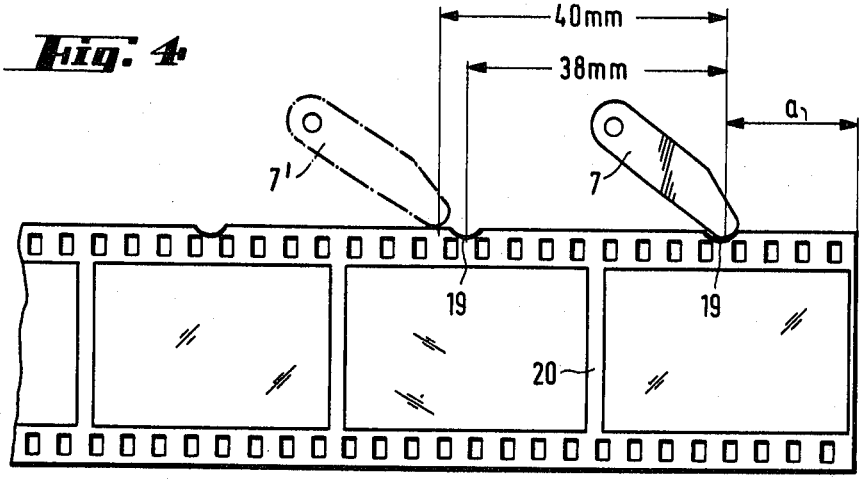
FIG. 4 is a plan view of a notched film having a normal frame spacing.
Figure 5:
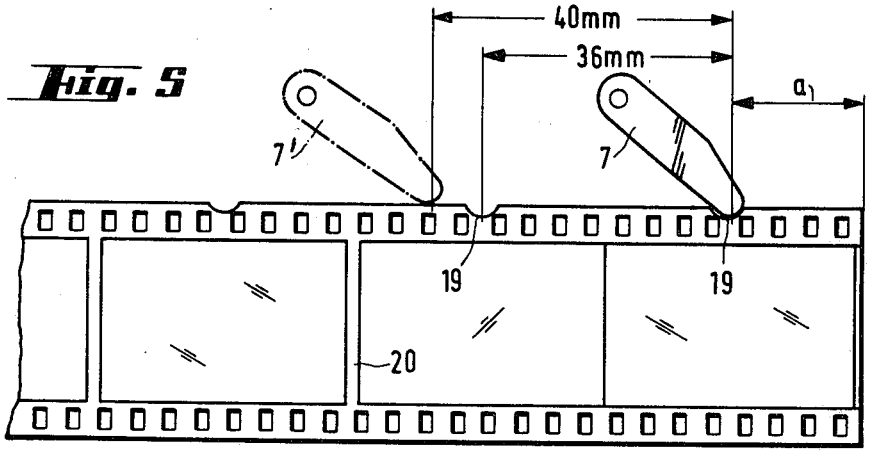
FIG. 5 is a plan view of a notched film having a smaller than normal frame spacing.
Figure 6:
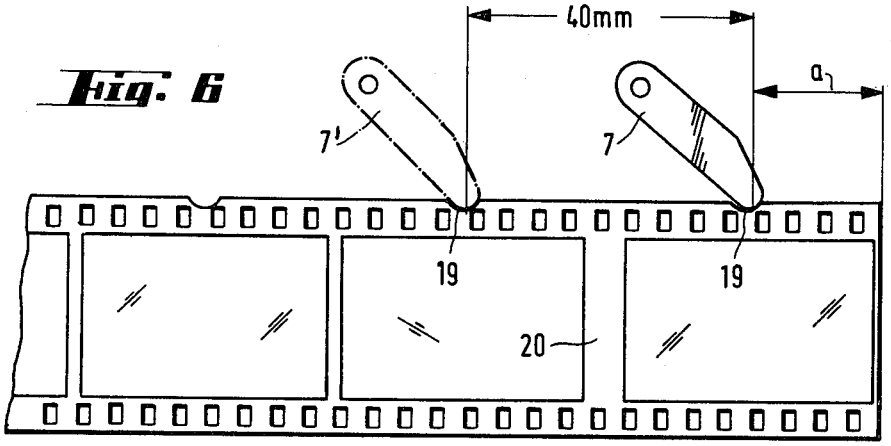
FIG. 6 is a plan view of a film with a larger than normal frame spacing.

A few characteristic cases are illustrated in FIGS. 4, 5 and 6. In FIG. 4, the spacing between two frames of a miniature film is exactly 38 mm. This is the standard frame (image) spacing. The gripper 7 executes its fixed stroke of 40 mm. The gripper 7 is in the illustrated position 7′ and first slides beyond the edge notch 19 and then drops into the notch 19 during movement of the carriage 6 in the direction of the arrow 17 after it has first executed an idling stroke of 2 mm. After a distance of a further 2 mm, the switch 12 actuated by the cam plate 11 drops off. However, the feeding step is executed completely because the switch 10 continues to activate the magnetic clutch 13.

FIG. 5 shows closely juxtaposed frames having a spacing of 36 mm. These photographs can still be properly framed because their image portions do not overlap. Here, again, the feed gripper 7 first executes an idling stroke, in this case of 4 mm, during its forward motion. Feeding takes place normally because the switch 12 falls off at the same instant as the switch 10 closes. If the spacing between the two frames were to be less than 36 mm, the switch 10 would not yet be closed when the switch 12 drops off and feeding would be interrupted.

FIG. 6 shows a film having a wide frame spacing. The frames are 40 mm apart, i.e. 2 mm more than the standard feeding step. Upon termination of the feeding stroke, the feed gripper 7 just drops into the next edge notch because the fixed stroke of the feeding mechanism is likewise 40 mm. When the switch 12 drops off after a 4 mm stroke, the gripper 7 is in an engaged position, i.e. the switch 10 is closed and the feeding stroke is executed completely. If the spacing of the frames were to be larger than 40 mm, the gripper 7 would be unable to drop into the edge notch 19. Consequently, the switch 12 of the feed gripper 7 would drop off in a position according to FIG. 2 and the switch 10 would be open, i.e. feeding would be interrupted.

Figure 7:
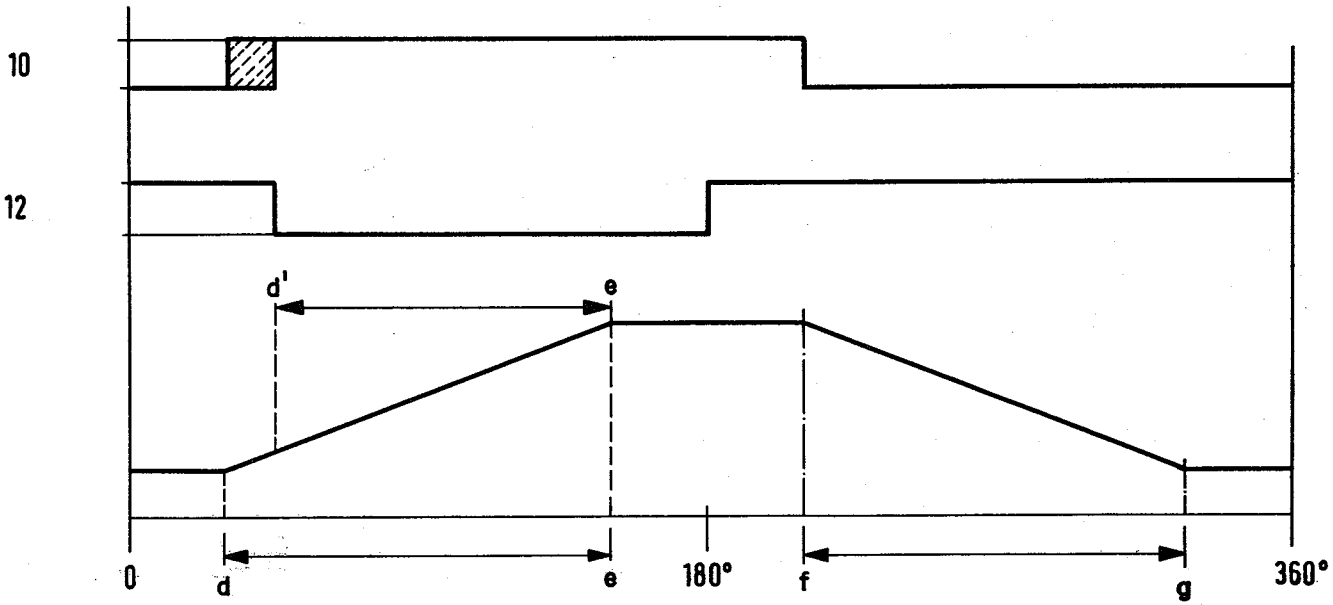
FIG. 7 is a diagram showing the association of the switching position for the switches 10 and 12 during feeding of the film.

The switch positions in dependence on the feed carriage position of the switches 10 and 12 are shown in FIG. 7, the crosshatched region of the switch 10 representing the zone in which feeding would still take place at a departure of the spacing of the edge notches from the normal spacing. During the period between the points "d" and "e" the carriage 6 moves in the direction of the arrow 17, while during the period between the points "f" and "g" the carriage 6 moves in the direction of the arrow 15. Film transport takes place between the points "d'" and "e". It will be appreciated that the location of the point "d'" is a function of the spacing between the notches 19.

The limiting position of the feed gripper 7 is at a fixed spacing 'a' (FIGS. 4, 5, 6) from the severing station of the framing machine. If the automatic notching machine is set so that the edge notch is disposed precisely at the middle of a frame, this spacing 'a' is exactly 19 mm, which is equal to half the normal spacing on 38 mm miniature film. Since this spacing 'a' is a fixed value to which the framing machine is set, each diapositive is cut off in precise relationship to the edge of the frame in the final position of the feed gripper 7 irrespective of the spacing to the next frame. This means that for automatic operation of the framing machine no manual image correction need be effected as long as the frame bar differences do not exceed ±2 mm. It has been found that with such frame bar differences, i.e. with such length fluctuations of the individual diapositives, an automatic framing machine can still be effectively operated with a suitable framing system. Any larger frame bar differences necessarily involve an interruption in the framing method because, if the frame spacing is less than 36 mm, the two frames will overlap and it will have to be decided whether one of the frames is to be framed and the remainder of the other image cut out or whether both overlapping photographs should be excluded from the film. If the frame bar spacing is larger than 40 mm, framing will no longer be possible because the length of film will then be too long and there will be insufficient space for it in the film-receiving portion of the frame. Since most frame bar differences lie within the range of ±2 mm, the arrangement according to the invention permits the framing machine to be operated automatically for the majority of all films.

We claim:

1. An apparatus for automatically framing an edge notched reversal film, the edge notches bearing predetermined relationships to image bearing portions of the film to be framed, said apparatus comprising:

means for feeding film including a feed gripper (7) engageable with an edge notch for feeding film, and drive means for moving said feed gripper through an operating cycle, the feed gripper during a first portion of the operating cycle engaging an edge notch and feeding the film, and the feed gripper during a second portion of the operating cycle disengaging from an edge notch and moving into a position for engaging a succeeding edge notch located within a predetermined range of variable spacings from the previously engaged edge notch; and first (12) and second (10) switch means for controlling said drive means, said first switch means (12) being actuatable by said drive means during the second portion of the operating cycle and being open during at least a part of said first portion of the operating cycle, said second switch means (10) being independent from said first switch means and being actuatable by engagement of said feed gripper with an edge notch, said drive means moving said feed gripper when at least one of said switch means is actuated.

2. Apparatus according to claim 1, characterized in that the drive means comprises a bell crank lever (3), and said film feeding means further comprises a cam plate (1) for pivoting said bell crank lever, a feed carriage (6) hingedly connected to said bell crank lever, said second switch means (10) being carried by said feed carriage, and a pivot (8) connecting the feed gripper (7) to said feed carriage.

3. Apparatus according to claim 1, characterized in that a lever arm (9) is rigidly secured to the pivot (8) so that movement of said feed gripper moves said lever arm, said lever arm actuating said second switch means when said feed gripper engages an edge notch, and a spring (14) for urging said lever arm away from said second switch means.

4. Apparatus according to claim 2 or claim 3, characterized in that the cam plate (1) is mounted on a shaft, the apparatus including a cam plate (11) mounted on the cam plate shaft for actuating the first switch means (12).

5. Apparatus according to claim 2 or 3, characterized in that an electric clutch (13) is provided between the drive means and the cam plate (1), said electric clutch being actuatable by the first and second switch means (10 and 12) which are connected in parallel to said electric clutch.

6. An apparatus for automatically framing reversal film, the film to be framed having an edge notch applied during processing of exposed film, the edge notches having a predetermined relationship to image bearing portions of film to be framed, said apparatus comprising:

a feed gripper (7) engageable with an edge notch;

a feed carriage (6) movable in a film feeding direction and in a return direction opposite the feeding direction;

means (8) for pivotally connecting said feed gripper with said feed carriage so that said feed carriage feeds film when said feed gripper is engaged with an edge notch;

drive means (3) for moving said feed carriage;

switch means for controlling said drive means, said switch means having a first switch (12) and a second switch (10); the first switch being actuatable during movement of the feed carriage (6) in the return direction, during initial movement of the feed carriage in the feeding direction, and during final movement of the feed carriage in the feeding direction; the second switch being actuatable by engagement of said feed gripper with an edge notch, the first switch being open during at least a portion of the movement of the feed carriage in the feeding direction so that movement of the feed carriage is stopped if the second switch has not been actuated whereby film is fed whenever said second switch is actuated prior to opening of said first switch.

* * * * *